US008777647B2

(12) United States Patent
Buehman et al.

(10) Patent No.: US 8,777,647 B2
(45) Date of Patent: Jul. 15, 2014

(54) CONNECTION SYSTEM AND METHOD

(75) Inventors: Ernest Richard-Dean Buehman, Maple Heights, OH (US); Dennis R. Young, Sheffield Village, OH (US); Jeffrey R. Kurowski, Streetsboro, OH (US)

(73) Assignee: Delta Systems, Inc., Streetsboro, OH (US)

( * ) Notice: Subject to any disclaimer, the term of this patent is extended or adjusted under 35 U.S.C. 154(b) by 260 days.

(21) Appl. No.: 13/313,058

(22) Filed: Dec. 7, 2011

(65) Prior Publication Data

US 2012/0142206 A1 Jun. 7, 2012

Related U.S. Application Data

(60) Provisional application No. 61/420,418, filed on Dec. 7, 2010.

(51) Int. Cl.
*H01R 13/52* (2006.01)

(52) U.S. Cl.
USPC ..... 439/271

(58) Field of Classification Search
USPC ..... 439/271, 587, 589, 272, 274, 275, 736, 439/283
See application file for complete search history.

(56) References Cited

U.S. PATENT DOCUMENTS

| | | | | |
|---|---|---|---|---|
| 7,059,901 | B2 * | 6/2006 | Morita et al. | 439/587 |
| 7,077,676 | B2 * | 7/2006 | Matsumoto et al. | 439/271 |
| 2006/0099842 | A1 * | 5/2006 | Hayashi | 439/271 |
| 2010/0060479 | A1 | 3/2010 | Salter | |
| 2011/0237104 | A1 * | 9/2011 | Biesse et al. | 439/271 |
| 2011/0312201 | A1 * | 12/2011 | Deno et al. | 439/271 |
| 2012/0015537 | A1 * | 1/2012 | Park | 439/271 |

OTHER PUBLICATIONS

Cluster Socket, Three-Pole Socket for Connecting Cluster Pins Data Sheet, 2 pgs. This cluster socket was sold or publically displayed more than 1 year prior to the filing date of the subject application, namely Dec. 6, 2009.

* cited by examiner

*Primary Examiner* — Jean F Duverne
(74) *Attorney, Agent, or Firm* — Tarolli, Sundheim, Covell & Tummino LLP

(57) ABSTRACT

A connection system for securing electrical components to a wiring harness includes a body connector having a first opening interconnected to a second opening by a transverse channel, the transverse channel supports a contact assembly along a first plane parallel with said first opening and is transverse to the second opening. The connection system also includes an annular seal surrounding a circular perimeter of a head formed on said body connector.

23 Claims, 17 Drawing Sheets

FIG. 14
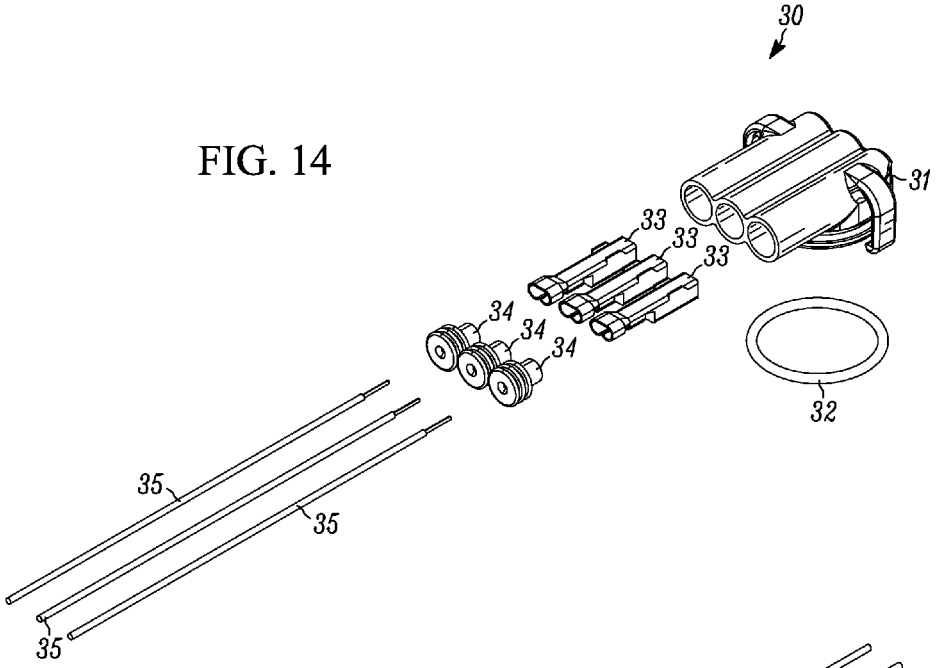
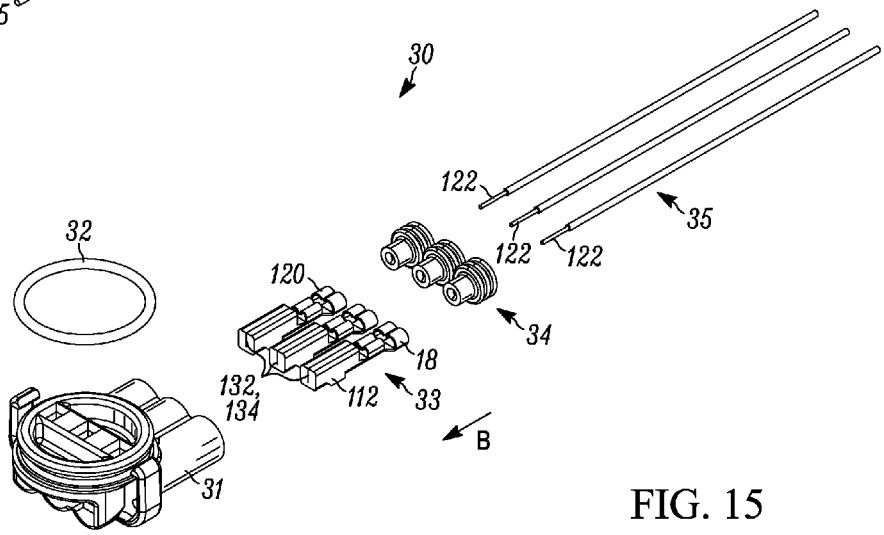
FIG. 15

CONNECTION SYSTEM AND METHOD

CROSS REFERENCES TO RELATED APPLICATIONS

The following application claims priority to co-pending U.S. Provisional Patent Application Ser. No. 61/420,418 filed Dec. 7, 2010 entitled CONNECTION SYSTEM AND METHOD. The above-identified application from which priority is claimed is incorporated herein by reference in its entirety for all purposes.

TECHNICAL FIELD

The present disclosure relates to a connection system and method for securing and/or interconnecting electronics to a wiring harness, and more specifically, providing a connection system that removably secures a wiring harness to a printed circuit board.

BACKGROUND

The cost and environmental interest associated with reducing energy demands has created products for monitoring both commercial and residential energy consumption. An example of a monitoring device is shown and described in U.S. Patent Publication No. U.S. 2010/0060479 entitled UTILITY MONITORING DEVICE, SYSTEM AND METHOD that was filed on Feb. 4, 2008 and assigned U.S. patent application Ser. No. 12/525,415 (hereinafter "the '479 Publication"). The '479 Publication is incorporated herein by reference in its entirety.

A monitoring device can track and measure the usage of any type of utility, including for example, electricity, natural gas, propane, water, phone, Internet, and the like. The monitoring device may further track and measure safety related aspects of a home or commercial establishment, such as carbon monoxide levels, fire detection, unauthorized entry, water usage, etc. The monitoring device can include a display and may be located at the residential or commercial site of interest. One or more transceivers can be part of the monitoring device for relaying and receiving information to/from a third party, such as a utility company, insurance company, or emergency response departments, such as fire departments and/or police departments. The transceiver and display may allow for the real-time costs associated with the consumption by the residential or commercial establishment to be viewed and/or automatically altered during peak or off-peak periods, thus reducing consumption and/or costs.

SUMMARY

One example embodiment of the present disclosure includes a connection system for securing electrical components to a wiring harness having a body connector with a first opening interconnected to a second opening by a transverse channel. The transverse channel supports a contact assembly along a first plane parallel with the first opening and transverse to a second plane parallel with the second opening. The connection system also comprises an annular seal surrounding the circular perimeter of a head formed on the body connector, the seal having an outer diameter greater than a diameter forming the circular perimeter of the head. The connection system further comprises a first m-shaped clasp formed within the contact for receiving a signal lead from the first opening and a second m-shaped clasp formed within the contact for receiving a signal lead from the second opening.

Another example embodiment of the present disclosure includes a kit forming a connection system for securing electrical components to a wiring harness, the kit forming the connection system comprises a body connector having a first opening interconnected by a transverse channel to a second opening, the first opening for receiving conducting contacts coupled to wire leads during assembly to a wiring harness. The second opening is for receiving conducting terminals during assembly to a wiring harness. The kit further comprises an annular seal surrounding a circular perimeter of a head formed on the body connector. The seal has an outer diameter greater than a diameter forming the circular perimeter of the head.

Yet another example embodiment of the present disclosure includes a method of securing electrical components to a wiring harness using a connecting system, the method comprises providing a body connector having a first opening interconnected to a second opening by a transverse channel and supporting a contact assembly with said transverse channel along a first plane parallel with said first opening and transverse to a second plane parallel with the second opening. The method also comprises sealing a circular perimeter of a head formed on said body connector with a gasket, said gasket having an outer diameter greater than a diameter forming the circular perimeter of said head.

BRIEF DESCRIPTION OF THE DRAWINGS

The foregoing and other features and advantages of the present disclosure will become apparent to one skilled in the art to which the present disclosure relates upon consideration of the following description of the invention with reference to the accompanying drawings, wherein like reference numerals, unless otherwise described refer to like parts throughout the drawings and in which:

FIG. 14 is a top-exploded perspective view of a connector assembly constructed in accordance with one example embodiment of the present disclosure;

FIG. 15 is a bottom-exploded perspective view of a connector assembly constructed in accordance with one example embodiment of the present disclosure;

DETAILED DESCRIPTION

Referring now to the figures generally wherein like numbered features shown therein refer to like elements throughout unless otherwise noted. The present disclosure relates generally to a connection system and method for securing and/or interconnecting electronics to a wiring harness, and more specifically, providing a connection system that removably secures a wiring harness to a printed circuit board in a confined space.

Figure 1:
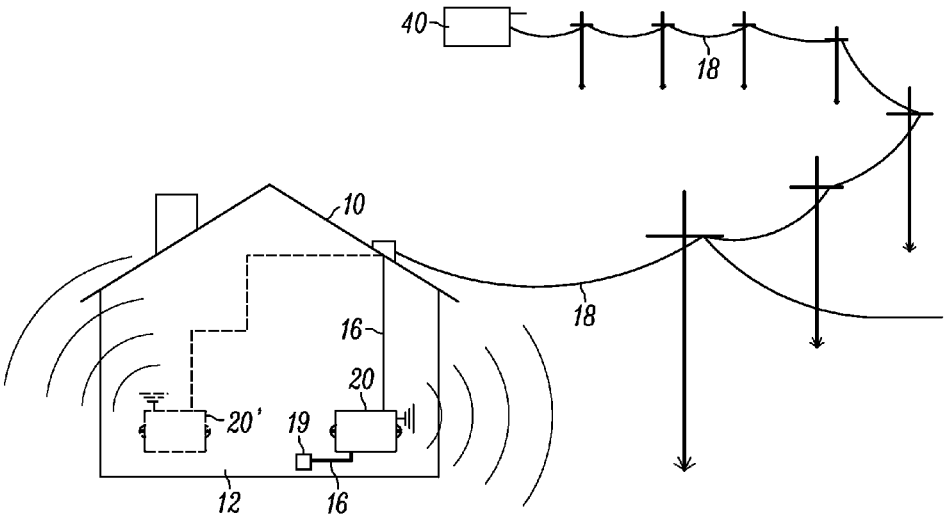
FIG. 1 is an elevation view of a residential or commercial establishment using a monitoring device having a connection system constructed in accordance with one example embodiment of the present disclosure.

FIG. 1 illustrates an elevation view of a residential or commercial establishment 10 using a monitoring device 20 having a connection system 30 located therein as further discussed below in accordance with one example embodiment of the present disclosure. The monitoring device 20 comprises a housing 22 typically formed of molded plastic, and includes a top portion 24 and bottom portion 26 that are divided by a central panel 25. Extending from a perimeter of the bottom portion 26 of the housing 22 are flanges 28 with through holes for securing the housing and monitoring device 20 to a flat surface such as the inside (see 20' in phantom of FIG. 1) or outside (see 20 of FIG. 1) of a wall 12 of the establishment 10.

Figure 2:
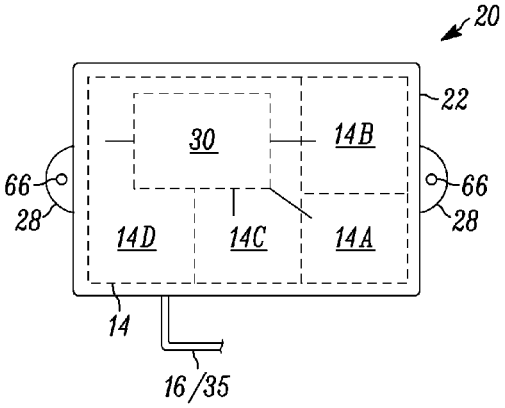
FIG. 2 is a plan view of a housing for a monitoring device constructed in accordance with one example embodiment of the present disclosure having a connection system.
Figure 3:
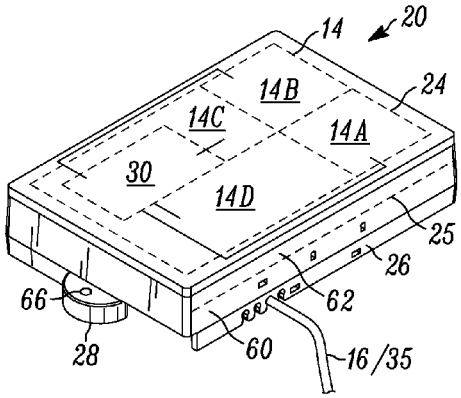
FIG. 3 is a perspective view of the housing of FIG. 2.

Part of, and located within the monitoring device 20 are electronics 14, that include, but are not limited to, hardware, firmware, software or combinations of each that perform actions, instructions, operations, or functions. In the illustrated example embodiment, the electronics 14 forming the monitoring device 20 includes, a processor, CPU, microcontroller, or application specific integrated circuit ("ASIC") or any combination thereof forming circuitry embodied by reference character 14A in the plan view of the example embodiments of FIGS. 2 and 3. The electronics 14 of the monitoring device 20 further comprise in the example embodiment of FIGS. 2 and 3, a user interface 14B, monitor or visual display 14C, and communication interface 14D that can include, for example, receivers, transmitters, transceivers, communication links, such as serial or parallel links, Bluetooth communication links, radio frequency ("RF") transmitters, or wireless links. The monitoring device 20 in the example embodiments of FIGS. 1-3 further comprises the connecting system 30 that is coupled or in communication with one or all of the electronics 14 of the monitoring device 20.

The monitoring device 20 can measure, track, adjust, and/or transmit utility consumption and/or safety aspect information such as carbon monoxide, fire, water, unauthorized entry and the like to third parties 40, which can include utility companies, fire/police departments, and the like. Such information is transmitted either wirelessly via a transceiver 14D to the third party 40 or by a wiring harness 16 coupled to the monitoring device 20 via the connecting system 30 to a series of landlines 18 to the third party. The wiring harness 16 in addition to being coupled to the landlines 18 and one or more components forming the electronics 14 of the monitoring device 20, is coupled to one or more sensors 19 that provide data relating to the utility usage and/or safety aspect information that is read by the monitoring device.

Figure 4:
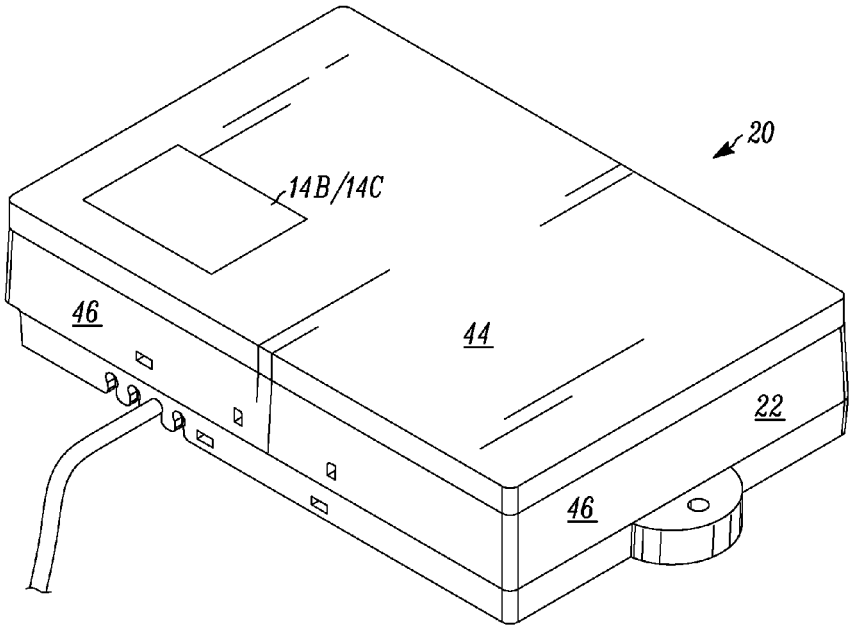
FIG. 4 is a second perspective view of the housing of FIG. 2.
Figure 12:
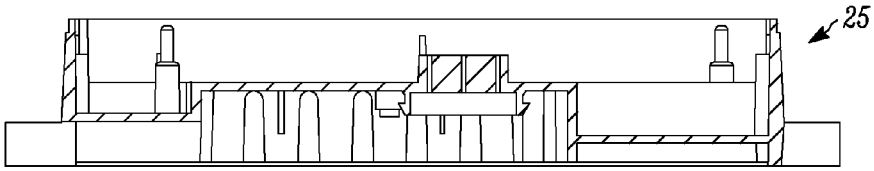
FIG. 12 is a sectional elevation view of the housing shown in FIG. 8 along section lines B-B.
Figure 7:
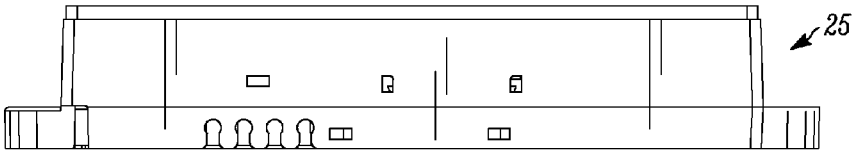
FIG. 7 is front elevation view of the housing of FIG. 5.

Referring again to FIG. 3 and now FIG. 4 are perspective views of the monitoring device 20, wherein the electronics are concealed within a cover 44 and sides 46 forming the housing 22. The cover 44 is positioned on the top portion 24 of the housing 22. In one example embodiment, the housing 22 is formed from plastic.

Figure 5:
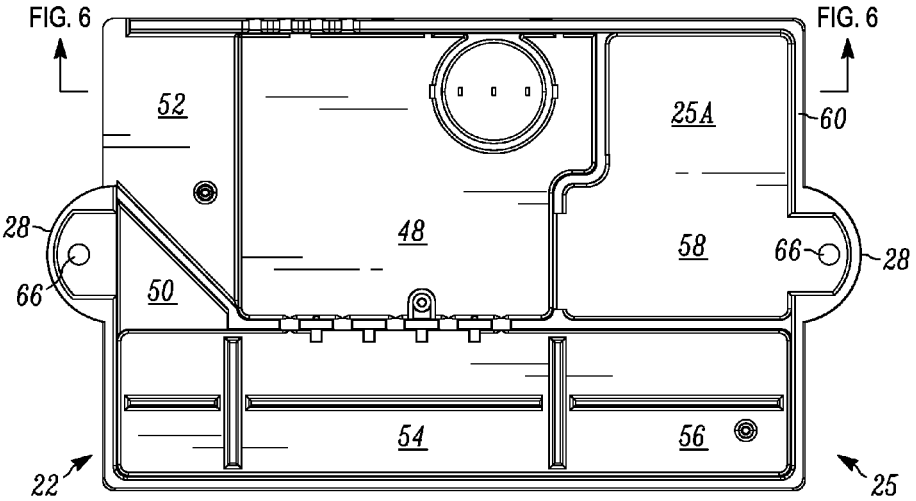
FIG. 5 is an internal bottom plan view of a housing constructed in accordance with one example embodiment of the present disclosure.
Figure 6:
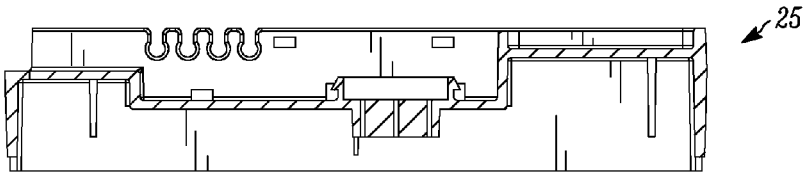
FIG. 6 is a sectional elevation view of the housing of FIG. 5 along section lines A-A.
Figure 9:
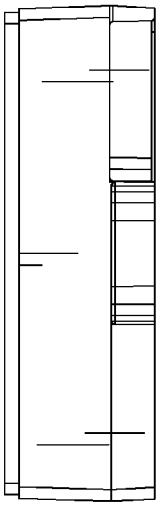
FIG. 9 is a first side elevation view of the housing of FIG. 5.
Figure 10:
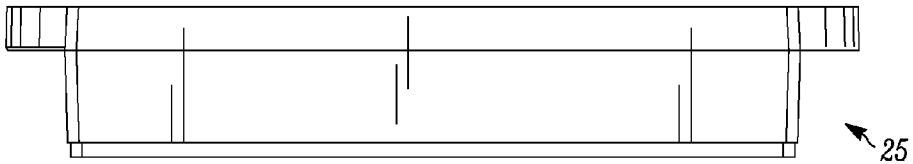
FIG. 10 is a rear elevation view of the housing of FIG. 5.

FIG. 5 illustrates a bottom perspective view of a central panel 25 of the housing 22 enclosing the monitoring device 20. The central panel 25 is formed from molded plastic and is either integrally formed with the housing 22 or separately formed and snapped into location within the housing, dividing top and bottom portions 24, 26, respectively. An under side 25A of the central panel 25, as shown in the example embodiment of FIG. 5 includes a primary bay 48 that supports the connection system 30 as discussed further below in detail. The cover 44 (see FIG. 4) includes an opening for a user interface 14B or visual display 14C. Additional or secondary bays 50-58 are divided among a lower region (or mount side) 60 of the central panel 25, which divides the lower region from an upper region 62 (see FIG. 3). The two flanges 28 include apertures 66 for the passage of fasteners (not shown) that secure the housing 22 and in particular the lower region 60 to a flat surface such as a wall 12.

Figure 8:
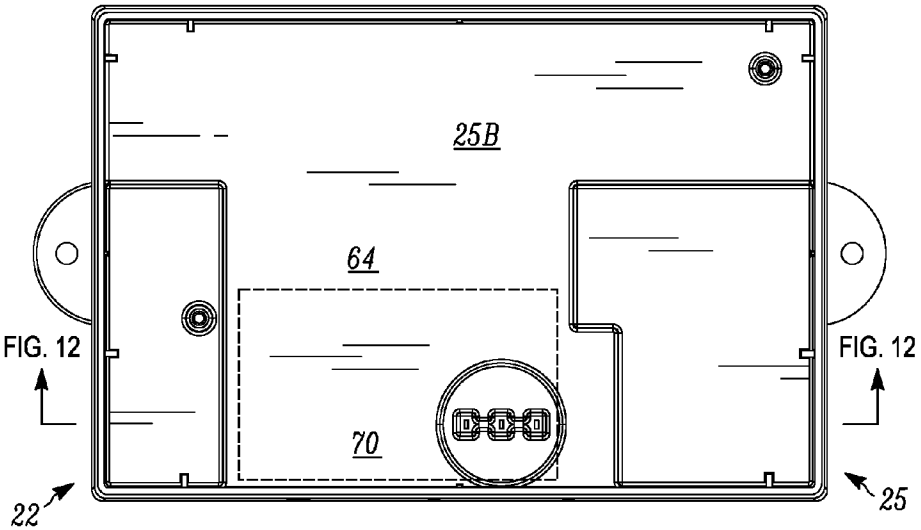
FIG. 8 is an internal top plan view of the housing of FIG. 5.
Figure 11:
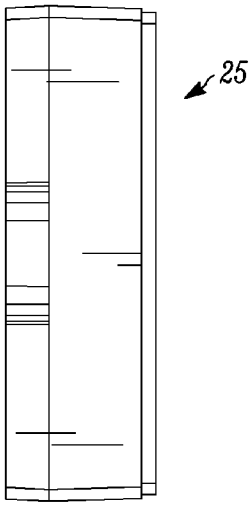
FIG. 11 is a second side elevation view of the housing of FIG. 5.

Seated within a secured bay 64 along an upper side 25B of the central panel are electronics 14A that support the monitoring device 20 and in the illustrated example embodiment of FIG. 8, the electronics 14A in the secured bay is in the form of a printed circuit board ("PCB") 70 having a plurality of terminal connectors 72 for transmitting signals or information, such as logic, electrical, electromagnetic, optical data, and the like. In the illustrated example embodiment of FIG. 13, the terminal connectors 72 pass from the secured bay 64 holding the PCB 70 through corresponding openings 76 in the central panel 25, extending from the upper side 25B to the lower side 25A.

The secured bay 64 forms a tamper-proof location for the electronics 14 of the monitoring device 20 between the central panel 25, cover 44, and sides 46 of the housing 22. In one example embodiment, the cover 44 is locked, preventing access to those without authorization. In the illustrated example embodiment of FIG. 13, the terminal connectors 72 include three (3) male terminal connectors that are coupled to the PCB 70, while more or less can be used with a connecting system to match without departing from the spirit and scope of the disclosure.

Figure 26:
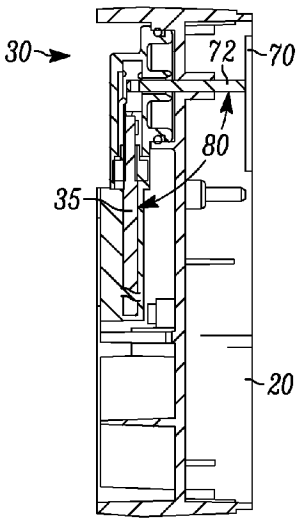
FIG. 26 is a sectioned elevation view of the connector assembly shown in the monitoring device of FIG. 25 along section lines F-F.
Figure 25:
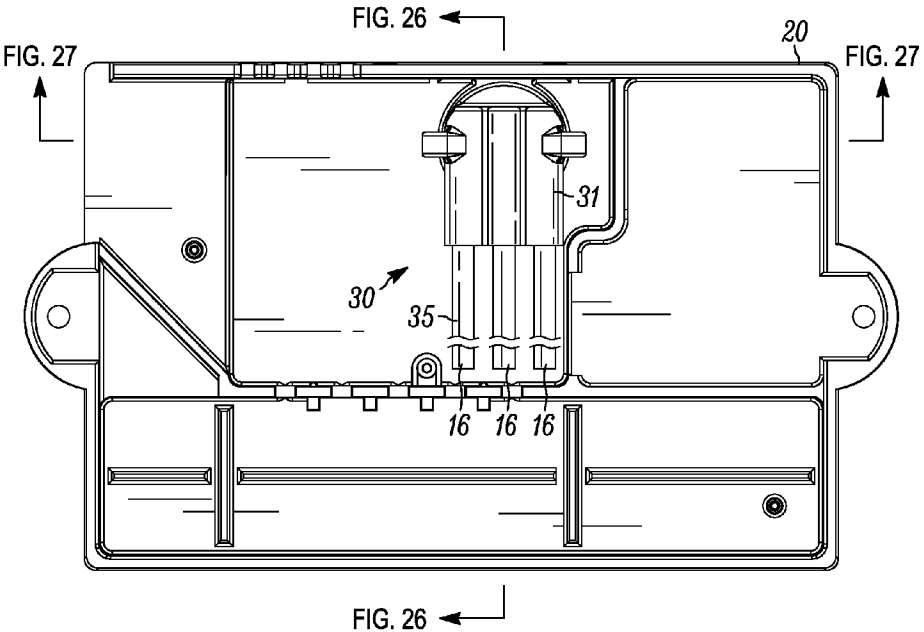
FIG. 25 is a plan view of the connector assembly installed within a monitoring device in accordance with one example embodiment of the present disclosure.
Figure 27:
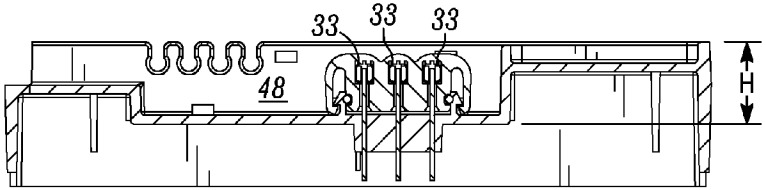
FIG. 27 is a sectioned elevation view of the connector assembly shown in the monitoring device of FIG. 25 along section lines H-H.

The connector system 30 includes a connector body 31, body seal 32, contacts 33, lead seals 34, and wire leads 35, as illustrated in the exploded assembly views of FIGS. 14 and 15. The connector system 30 provides a low profile connection between the electronics 14 of the monitoring device 20 and the wiring harness 16. More specifically, the connector body 31 provides a low profile transverse connection 80 between the wire leads 35 and the male terminals 72 of the PCB 70, as further illustrated in the example embodiments of FIGS. 16 and 25-27. In the illustrated example embodiment of FIGS. 25-27, the overall height of the connection system 30 located within the primary bay 48 is between one-half (½") and three-quarters (¾") of one inch and the transverse connection 80 is ninety degrees between the wire leads 35 and the male terminals 72. Further, the example embodiment of FIGS. 25-27 illustrate that the wire leads 35 are coupled to the wiring harness 16, or alternatively, are part of the wiring harness and are coupled to utility sensors 19, electronics 14, or both.

The connector body 31 in the illustrated example embodiment of FIGS. 17-27 is formed from molded plastic. The connector body 31 comprises a head 92, neck 94, arms 96, and face 98. Circumscribing an outer perimeter 100 of the head 92 is an annular seat 102 for nesting the body seal 32. In the illustrated embodiment, the body seal 32 is a rubber or neoprene o-ring. The body seal 32 is designed to fully seal and protect the housed electronics 14 located between the central panel 25 and cover 44 from the extremities exposed to the under-side 25A of the housing 22.

A two-stage diameter transverse channel 104 is formed in the neck 94 that extends to the head 92 of the connector body 31, which supports each of the wire leads 35, lead seals 34, and contacts 33. The channels 104 include a first opening 106 that extend through the connector body 31 transversely out a second opening 108 as best seen in the section views of FIGS. 22 and 24. The second opening 108 of the channel 104 includes an annular chamfered opening 110 for conveniently guiding the terminals 72 as each enters the connector body 31 through a respective channel in the direction of Arrow "A" in FIG. 22.

The contacts 33 include at a first end 112 (see FIG. 15) having an m-shaped clasp 114 (see FIG. 22) for receiving respective terminals 72 at an engageable center 116, reassuring a signal generating connection is made when the connector body 31 is mated with the terminals 72 of the PCB 70. The contacts 33 are positioned such that the m-shaped clasps 114 are positioned centrally over the second opening 108 of the transverse channel 104. Once the contacts 33 are positioned into their respective transverse channel through the first opening 106 (in the direction of Arrow "B" in FIG. 24), the lead seals 34 are positioned within a first stage recess 124 (also in the direction of Arrow "B") at the first opening until a first diameter 126 of the lead seals engages the bottom of a counter bore 128 of the first stage recess. A second stage 130 of the transverse channel has a relatively smaller diameter than the first stage 124 through the neck 94 portion of the head 92, as best seen in FIG. 24.

Figure 20:
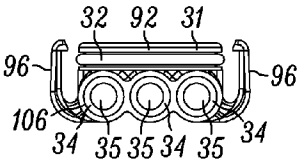
FIG. 20 is a rear end view of a connector assembly constructed in accordance with one example embodiment of the present disclosure.
Figure 22:
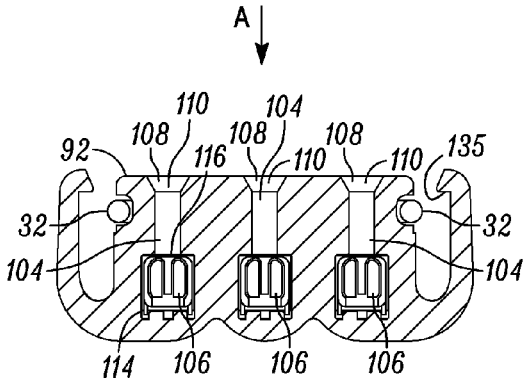
FIG. 22 is a sectioned elevation view of the connector assembly shown in FIG. 17 along lines C-C.
Figure 23:
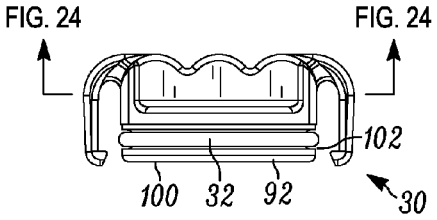
FIG. 23 is a front end view of a connector assembly constructed in accordance with one example embodiment of the present disclosure.

At a second end 118 (see FIG. 15) of the contacts 33 opposite the first end 112 are annular receipts 120 for receiving conductive ends 122 of wire leads 35 in a press-fit connection. Once the contacts 33 and lead seals 34 are positioned into the connector body 31 through the first opening 106 in the direction of Arrow B of FIG. 25, the wire leads can be inserted into the contacts. The conductive ends 122 of the wire leads 35 are inserted into the contacts 33 as illustrated in FIG. 20, such that the lead seals 34 reassure that the electronics 14 remain free of moisture and debris. In the illustrated example embodiment, the wire leads 35 are 22 gage wire is used and the lead seals 34 are 22 gage insulated conductors forming a seal estimated to withstand IP67 requirements.

Figure 24:
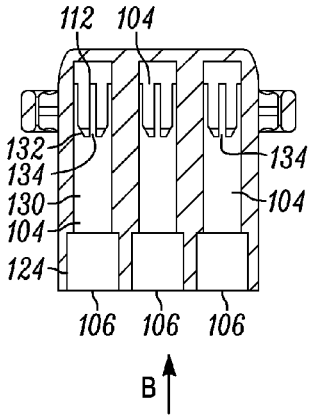
FIG. 24 is a sectioned plan view of the connector assembly shown in FIG. 23 along lines E-E.

In yet another example embodiment, the conductive ends 122 are press fit into an m-shaped clasp 132 located at the first end of the contact 33 as best seen in FIG. 24. The m-shaped clasp 132 comprises an engageable center 134 for receiving the conductive ends 122 of wire leads 35, reassuring a signal generating connection is made between the wiring harness 16 and PCB 70 when the connector body 31 is mated with the terminals 72.

In one example embodiment, the contacts 33 are fabricated from a conductive material such as copper. In another example embodiment, the contacts are a purchased product. One suitable example of contacts 33 include Delphi Terminal Connectors sold by Delphi Packard Electric Systems under part number 120666643. The specification sheet for the Delphi Terminal Connectors is incorporated herein by reference. In another example embodiment, the lead seals 34 are made from rubber or elastomeric gasket material. One suitable example of lead seals 34 include Delphi Metricpack Terminal Seals 280 sold by Delphi Packard Electric Systems.

Figure 13:
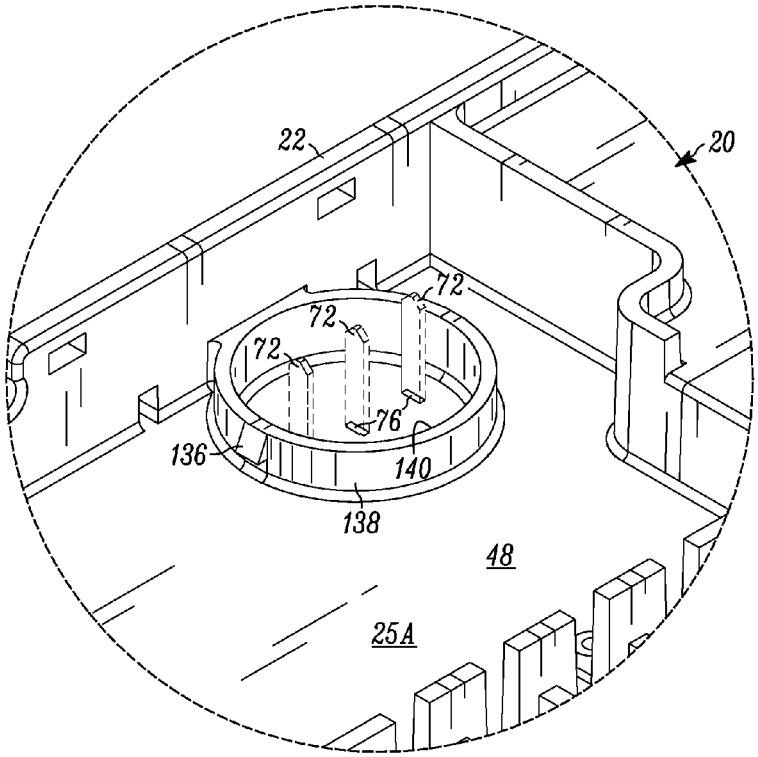
FIG. 13 is a partial perspective lower side view of the housing of FIG. 5.
Figure 16:
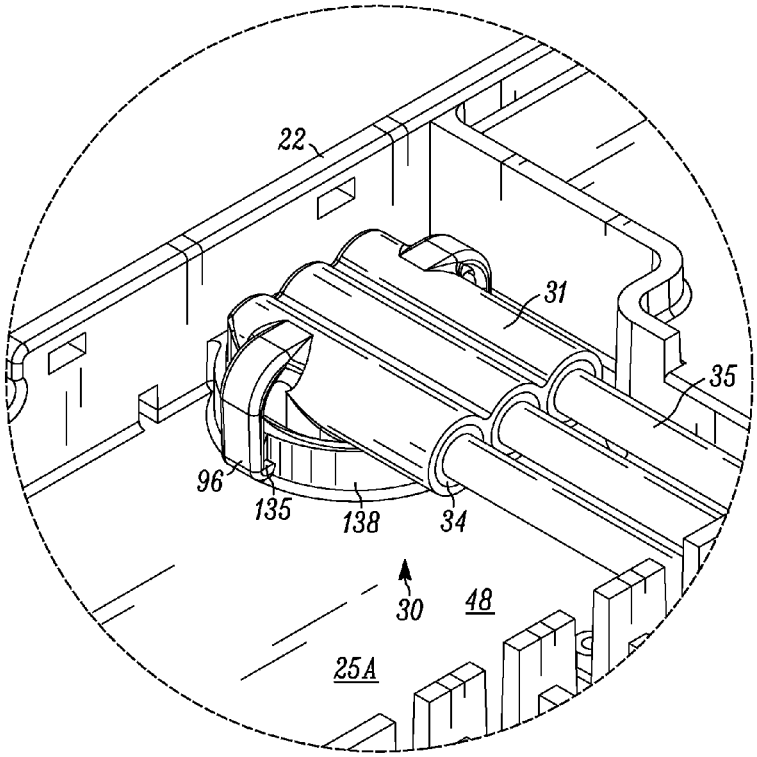
FIG. 16 is a perspective view of the connector assembly attached to a central panel positioned within a housing of a monitoring device in accordance with one example embodiment of the present disclosure.
Figure 19:
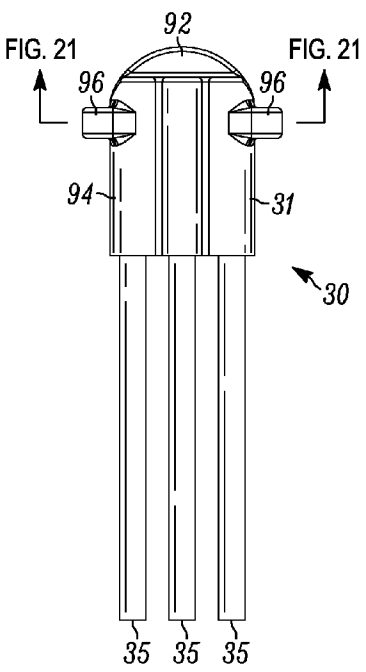
FIG. 19 top plan view of a connector assembly constructed in accordance with one example embodiment of the present disclosure.
Figure 21:
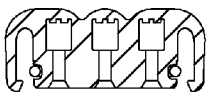
FIG. 21 is a sectioned elevation view of the connector assembly shown in FIG. 19 along lines D-D.
Figure 18:
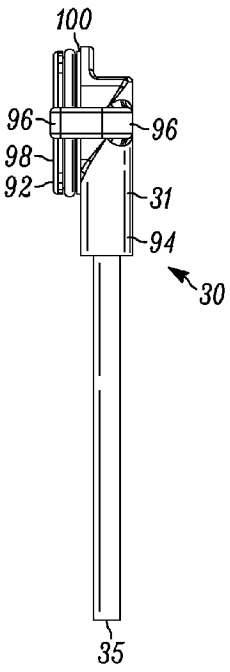
FIG. 18 side elevation view of a connector assembly constructed in accordance with one example embodiment of the present disclosure.
Figure 17:
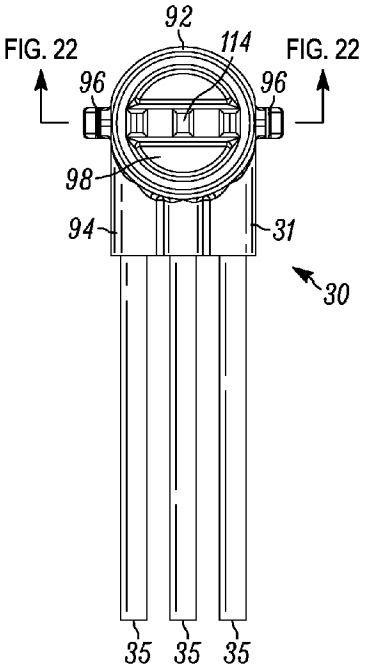
FIG. 17 is a bottom plan view of a connector assembly constructed in accordance with one example embodiment of the present disclosure.

First and second arms 96 are symmetrically positioned about the head 92 of the connector body 31. The arms 96 provide a securing, yet selectively removable connection between the central panel 25 and the connector body 31, reassuring a signal generating connection is being made between the electronics 14 and wiring harness 16. More specifically, the arms 96 have pawls 135 that grasp corresponding catches 136 formed in a riser 138 that extends away from the lower side 25A of the central panel 25 as best seen in FIGS. 13 and 16. The riser 138 has an inner diameter 140 such that the body seal 32 forms a sealing connection that prevents the entry of moisture or debris within the inner diameter 140 when the connection system 30 is attached to the riser.

By attaching the body seal 32 between the riser 138 and connector body 31, and not over the terminals 72 with a conventional gasket, the overall stack-up height of the connector system 30 is advantageously reduced. This allows for the connector system 30 to be used in applications where space, and in particular, height is limited. In one example embodiment, the height "H" as illustrated in FIG. 27 is approximately one-half of one inch (½"). In yet another example embodiment, the connector system 30 further comprises a keying feature in order to prevent improper assembly between the riser 138 and connector body 31. One such example would include a male key extending from the inside of the riser 138 that is received within a receipt the connector body 31.

The low profile connection provided by the connection system 30 provides a method of disconnecting the harness 16 from the PCB 70 in a confined space when the height for an application is limited. The low profile characteristic is achieved by several of the features described throughout this disclosure, including for example, the transverse annular channel 104, the assembly forming the connector system 30, and the positioning of the body seal 32 about the connector body 31.

In the illustrated example embodiment of FIGS. 16 and 25-27, the connection system 30 is also advantageously field serviceable in that the wire leads 35 coupled to the wiring harness 16 can be disconnected from the enclosure by removing the connector body 31 from the terminals 72. The connector system 30 further advantageously provides a completely sealed system through the lead seals 34 and body seal 32, providing an environment to the electronics 14 free of moisture and/or debris. The sealed electronics 14 in the secure bay 64 opposite the primary bay 48 further provide an advantage of a safe tamper-proof security feature where the electronics are locked into the housing 22 and the monitoring device 20 can only be removed by disconnecting the connecting system 31.

FIGS. 28-50 illustrate a connector system 230 constructed in accordance with another example embodiment of the present disclosure. The connector system 230 is designed to adapt to the housing 22 of a monitoring device 20.

Figure 28:
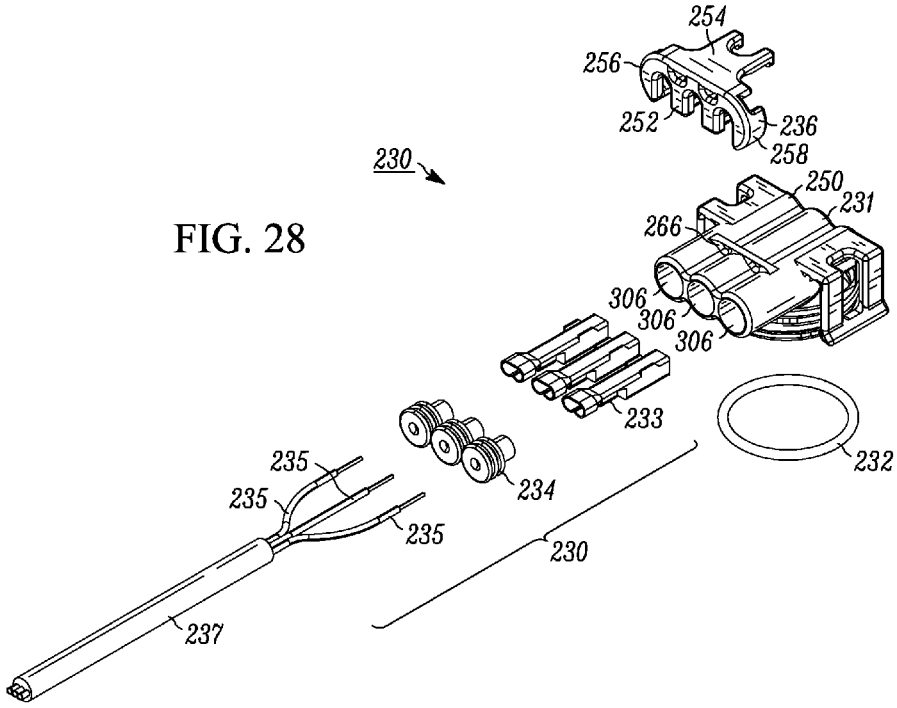
FIG. 28 is a top-exploded perspective view of a connector system constructed in accordance with another example embodiment of the present disclosure.
Figure 29:
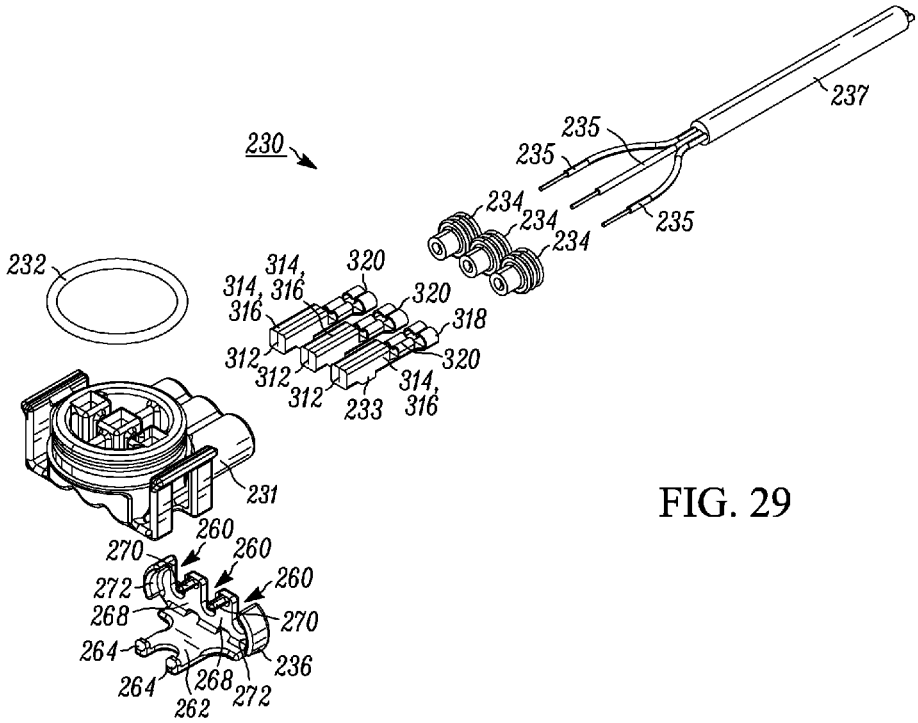
FIG. 29 is a bottom-exploded perspective view of a connector system constructed in accordance with another example embodiment of the present disclosure.
Figure 30:
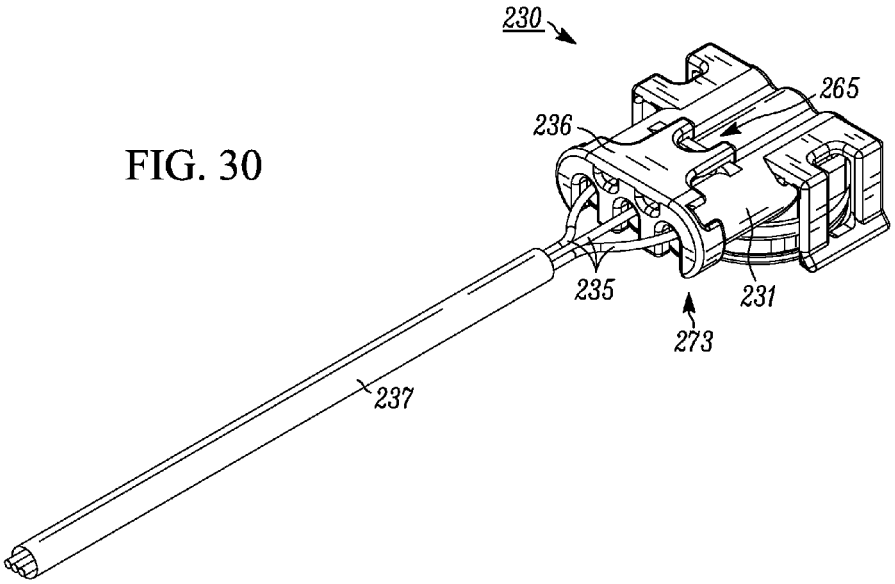
FIG. 30 is an assembled top perspective view of the connector system of FIGS. 28-29.
Figure 31:
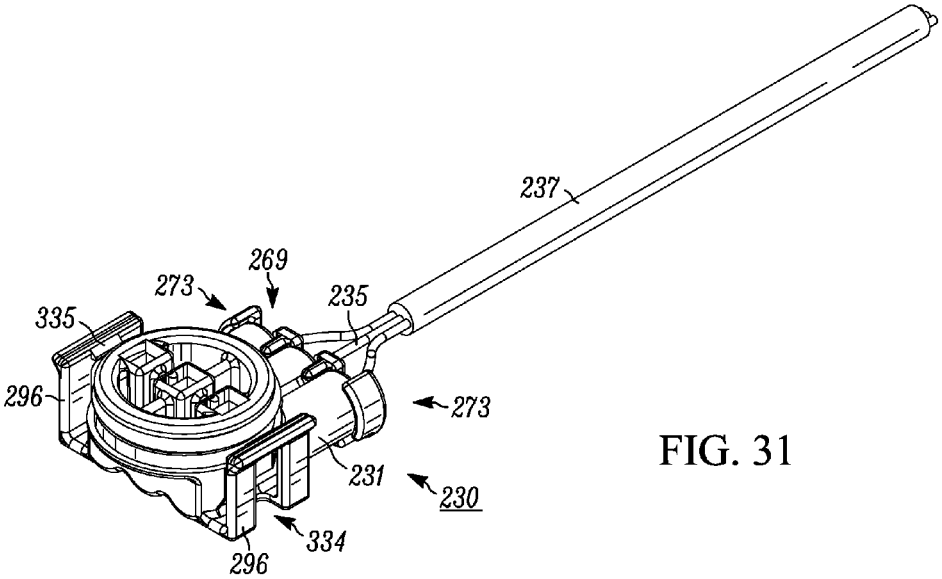
FIG. 31 is an assembled bottom perspective view of the connector system of FIGS. 28-29.

The connector system 230 includes a connector body 231, body seal 232, contacts 233, lead seals 234, wire leads 235, locking arrangement 236, and conduit 237 as illustrated in the exploded assembly views of FIGS. 28 and 29. The connector system 230 provides a low profile connection between the electronics 14 of the monitoring device 20 and the wiring harness 16. More specifically, the connector body 231 provides a low profile transverse connection 80 (see FIGS. 26 and 38) between the wire leads 235 and the male terminals 72 of the PCB 70, as further illustrated in the example embodiments of FIGS. 37-40.

The conduit 237 is a protective shroud or cover surrounding the wire leads 235 that can be stripped away from the lead ends upon connection. However, it should be appreciated that the connecting system 230 could be any number of wire leads 235 with or without the conduit 237 without departing from the scope or spirit of the present disclosure.

In the illustrated example embodiment of FIGS. 37-40, the overall height of the connection system 230 located within the primary bay 48 is between one-half (½") and three-quarters (¾") of one inch as indicated by reference character "H" and the transverse connection 80 is ninety degrees between the wire leads 235 and the male terminals 72. Further, the example embodiment of FIGS. 37-40 illustrate that the wire leads 235 are coupled to the wiring harness 16, or alternatively, are part of the wiring harness and are coupled to utility sensors 19, electronics 14, or both.

The connector body 231 in the illustrated example embodiment of FIGS. 28-31 and more detailed in FIGS. 41-45 is formed from molded plastic. The connector body 231 comprises a head 292, neck 294, snap wings 296, and face 298. Circumscribing an outer perimeter 300 of the head 292 is an annular seat 302 for nesting the body seal 232. In the illustrated embodiment, the body seal 232 is a rubber or neoprene o-ring. The body seal 232 is designed to fully seal and protect the housed electronics 14 located between the central panel 25 and cover 44 from the extremities exposed to the underside 25A of the housing 22.

Figure 32:
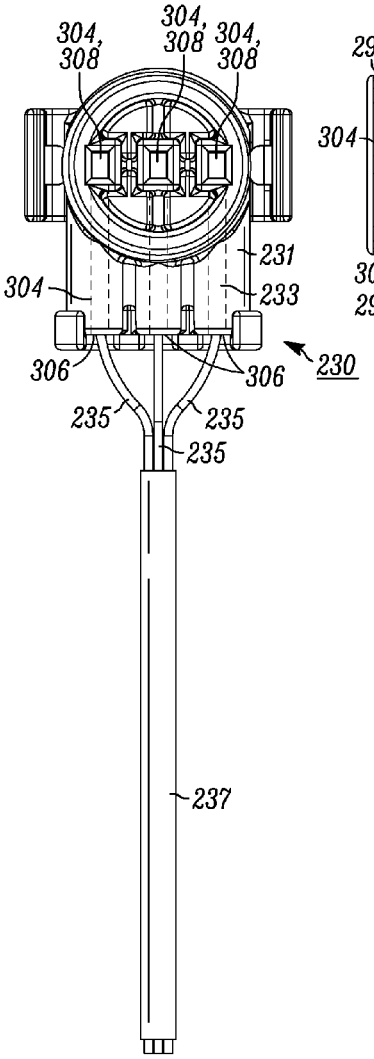
FIG. 32 is a bottom plan view of the connector system constructed in accordance with the example embodiment of FIGS. 28-29.
Figure 33:
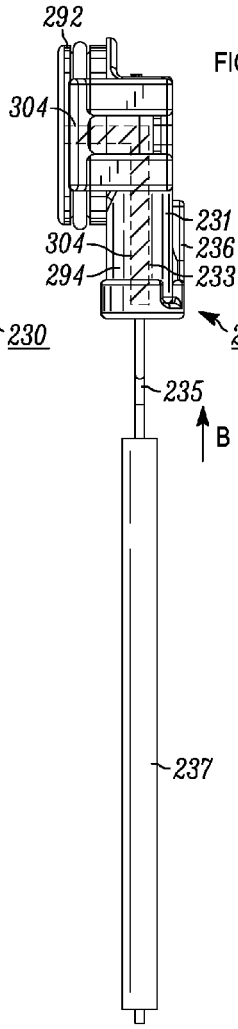
FIG. 33 side elevation view of the connector system constructed in accordance with the example embodiment of FIGS. 28-29.
Figure 34:
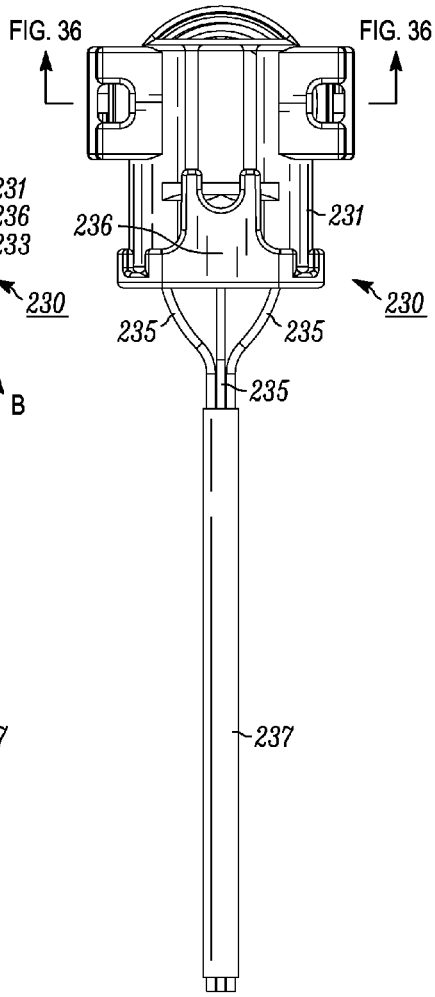
FIG. 34 top plan view of the connector system constructed in accordance with the example embodiment of FIGS. 28-29.
Figure 36:
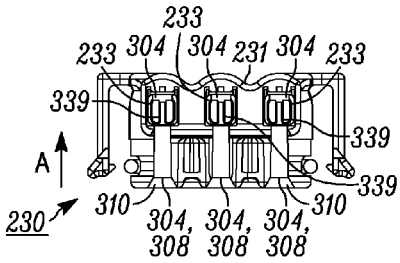
FIG. 36 is an elevated section view of FIG. 34 along section lines 36-36.
Figure 38:
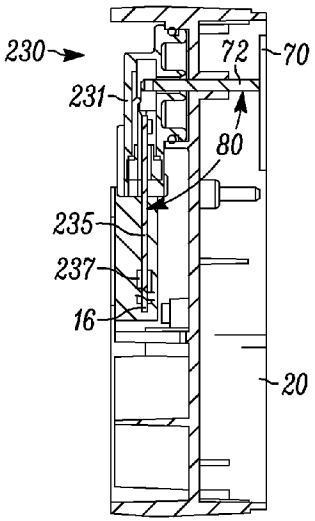
FIG. 38 is a sectioned elevation view of the connector system shown in the monitoring device of FIG. 37 along section lines 38-38.
Figure 37:
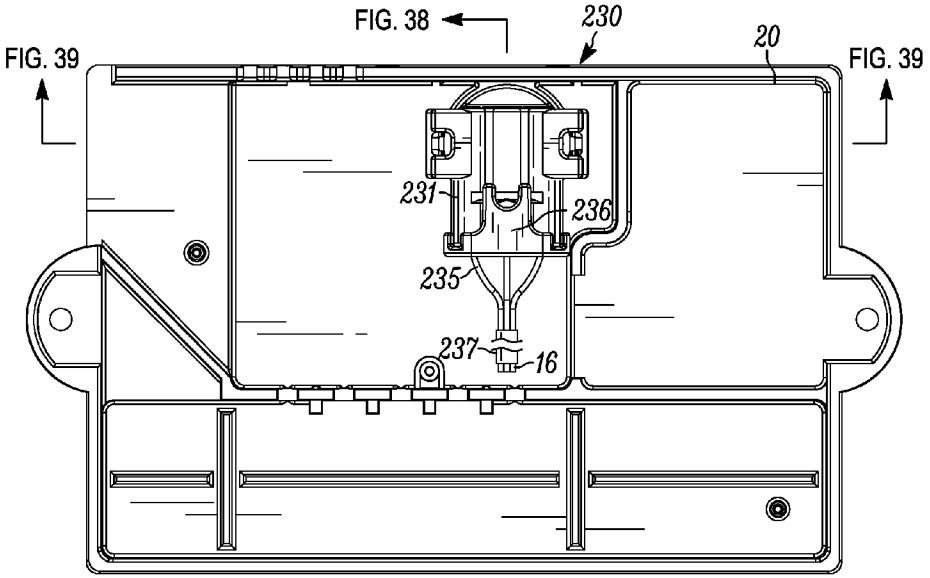
FIG. 37 is a plan view of the connector system of FIGS. 28-29 installed within a monitoring device in accordance with one example embodiment of the present disclosure.

A two-stage diameter transverse channel 304 is formed in the neck 294 that extends to the head 292 of the connector body 231, which supports each of the wire leads 235, lead seals 234, and contacts 233, as illustrated for example in FIGS. 32-33, and 36. The channels 304 include a first opening 306 that extend through the connector body 231 transversely out a second opening 308 as best seen in FIGS. 32-33 and 36. The second opening 308 of the channel 304 includes an annular chamfered opening 310 for conveniently guiding the terminals 72 as each enters the connector body 231 through a respective channel in the direction of Arrow "A" in FIG. 36.

The contacts 233 include at a first end 312 having a square receipt 314 that includes an engageable center 316 comprising an m-shaped clasp 339 (see FIG. 36) for receiving respective terminals 72, reassuring a signal generating connection is made when the connector body 231 is mated with the terminals 72 of the PCB 70. The contacts 233 also include a second end 318 (opposite the first end 312) having an m-shaped clasp 320 for receiving the wire leads 235.

The wire leads 235 pass through respective seals 234 before being crimped within respective m-shaped folds 320. Once the wire leads 235 are coupled with contacts 233 to have a conductive connection (reassuring a signal generating connection is made between the wiring harness 16 and PCB 70 when the connector body 231 is mated with the terminals 72)

by for example crimping, the contacts 233, leads 235, and seals 234 are inserted into the first opening 306 within the neck 294 of the body 231.

The contacts 233 are positioned such that the square receipts 314 are positioned substantially centrally over the second opening 308 of the transverse channel 304. The contacts 233 bottom out against the inside of their respective transverse channel 304 through the first opening 306 in the direction of Arrow "B" in FIG. 33 such that the receipts 314 are positioned substantially centrally over the second opening 308. This allows for proper alignment of the terminals 72 with respective receipts 314.

The lead seals 234 and body seal 232 reassure that the electronics 14 remain free of moisture and debris. In the illustrated example embodiment, the wire leads 235 are 22 gage wire and the lead seals 234 are 22 gage insulated conductors forming a seal estimated to withstand IP67 requirements.

In one example embodiment, the contacts 233 are fabricated from a conductive material such as copper. In another example embodiment, the contacts are a purchased product. One suitable example of contacts 233 include Delphi Terminal Connectors sold by Delphi Packard Electric Systems under part number 120666643. The specification sheet for the Delphi Terminal Connectors is incorporated herein by reference. In another example embodiment, the lead seals 234 are made from rubber or elastomeric gasket material. One suitable example of lead seals 234 include Delphi Metricpack Terminal Seals 280 sold by Delphi Packard Electric Systems.

Figure 40:
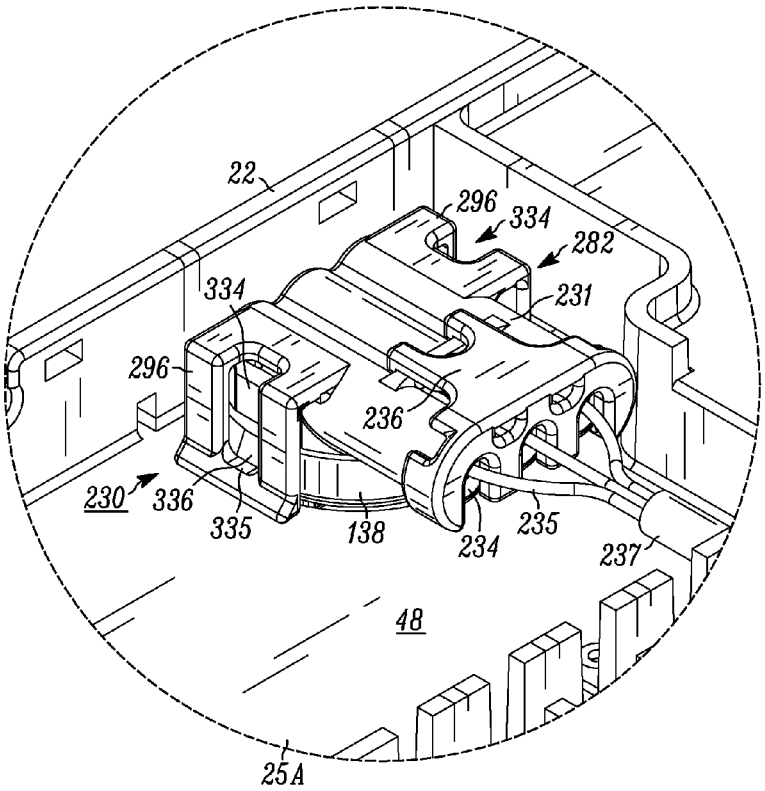
FIG. 40 is a partial perspective lower side view of the housing of FIG. 5 supporting a connector system of FIGS. 28-29 in accordance with one example embodiment of the present disclosure.
Figure 41:
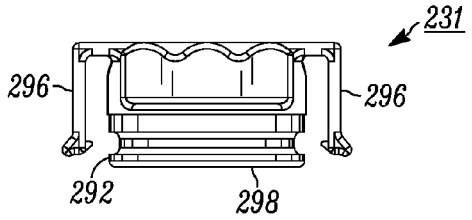
FIG. 41 illustrates an elevated rear view of a connector body constructed in accordance with another example embodiment of the present disclosure.
Figure 42:
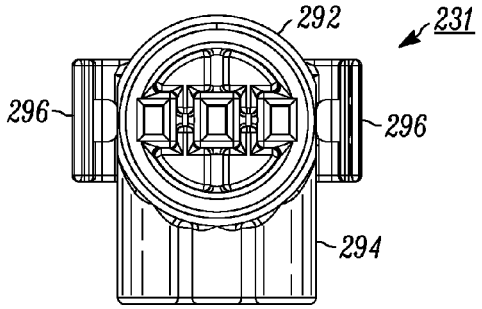
FIG. 42 illustrates a bottom plan view of the connector body of FIG. 41.
Figure 43:
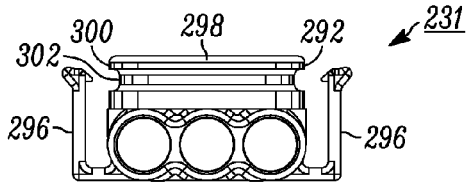
FIG. 43 illustrates an elevated front view of the connector body of FIG. 41.
Figure 44:
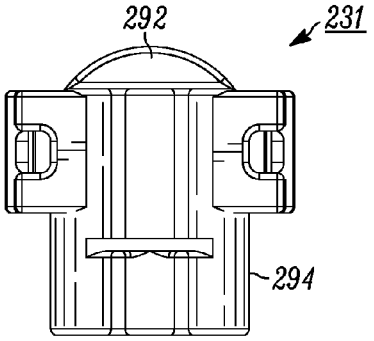
FIG. 44 illustrates a top plan view of the connector body of FIG. 41.
Figure 45:
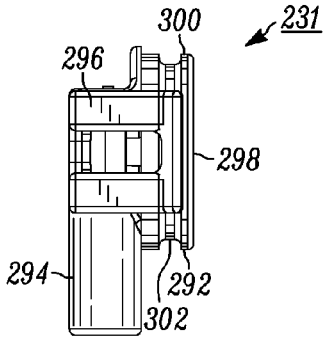
FIG. 45 illustrates an elevated side view of the connector body of FIG. 41.
Figure 46:
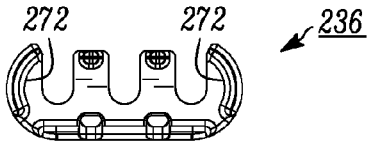
FIG. 46 illustrates an elevated rear view of a locking arrangement constructed in accordance with another example embodiment of the present disclosure.
Figure 47:
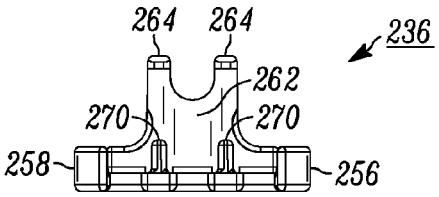
FIG. 47 illustrates a bottom plan view of the locking arrangement of FIG. 46.
Figure 48:
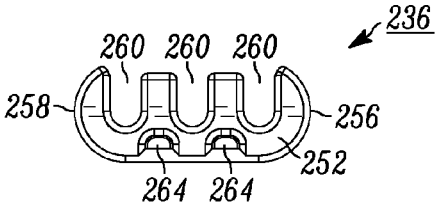
FIG. 48 illustrates an elevated front view of the locking arrangement of FIG. 46.
Figure 49:
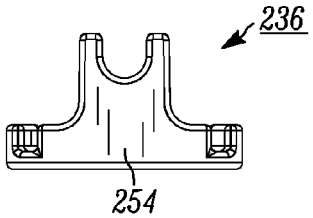
FIG. 49 illustrates a top plan view of the locking arrangement of FIG. 46.
Figure 50:
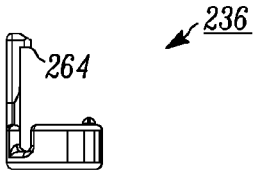
FIG. 50 illustrates an elevated side view of the locking arrangement of FIG. 46.

First and second snap wings 296 are symmetrically positioned about the head 292 of the connector body 231. The snap wings 296 provide a securing, yet selectively removable connection between the central panel 25 and the connector body 231, reassuring a signal generating connection is being made between the electronics 14 and wiring harness 16. More specifically, the snap wings 296 each comprise a channel opening 334 pawls 335 that grasp corresponding catches 336 formed in a riser 138 that extends away from the lower side 25A of the central panel 25 as best seen in FIG. 40. The riser 138 has an inner diameter 140 such that the body seal 232 forms a sealing connection that prevents the entry of moisture or debris within the inner diameter 140 when the connection system 230 is attached to the riser.

Figure 39:
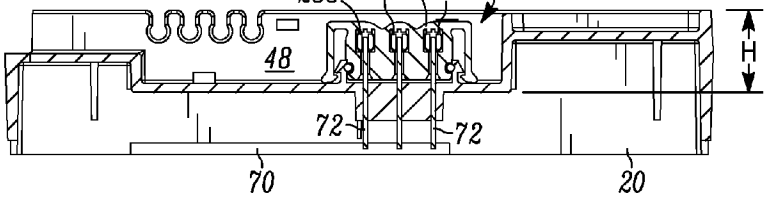
FIG. 39 is a sectioned elevation view of the connector system shown in the monitoring device of FIG. 37 along section lines 39-39.

By attaching the body seal 232 between the riser 138 and connector body 231, and not over the terminals 72 with a conventional gasket, the overall stack-up height of the connector system 230 is advantageously reduced. This allows for the connector system 230 to be used in applications where space, and in particular, height is limited. In one example embodiment, the height "H" as illustrated in FIG. 39 is approximately one-half of one inch (½"). In yet another example embodiment, the connector system 230 further comprises a keying feature in order to prevent improper assembly between the riser 138 and connector body 231. One such example would include a male key extending from the inside of the riser 138 that is received within a receipt the connector body 231.

Illustrated in FIGS. 46-50 is the locking arrangement 236. The locking arrangement 236 mounts on a top surface 250 of the body 231 and covers 306, locking the wires 235, conductors 233, and lead seals 234 once installed into the body. In one example embodiment, the locking arrangement 236 is molded and made from plastic.

Figure 35:
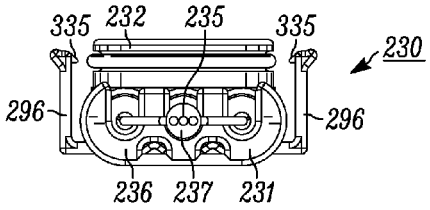
FIG. 35 is an elevated end view of FIG. 32.

The locking arrangement 236 comprises a front 252, top 254, and first and second side 256, 258, respectively. The front 252 includes a plurality of arcs 260 corresponding to the number of openings 306 in the body 231. The locking arrangement 236, and in particular, the arcs 260 surround the seals 234 allowing only room for passing of the leads 235 when installed on the body as illustrated in FIG. 35.

Located on a lower surface 262 opposite the top surface 254 are first and second bosses 264 that provide a first locking connection 265 with a catch 266 located on the top 250 surface of the body 231. Located on a back surface 268 of the front surface 252 are first and second posts 270. The first and second posts 270 provide a second locking connection 269 with the locking arrangement 236 and the body 231. Internal to the first and second sides, 256, 258, are arcuate regions 272 that form a third locking connection 273 with the locking arrangement 236 and the body 231.

During assembly, the wire leads 235 pass through their respective seals 234 and coupled (by for example crimping or soldering) to their respective conductors 233 to form a terminal assembly 280. Each terminal assembly 280 is seated into the respective first openings 306 of the body 231. The terminal assembly 280 is nested such that the receipts 314 are positioned substantially centrally over the second opening 308, allowing for proper alignment of the terminals 72 with respective receipts 314 when the body 231 is pushed or seated onto the riser 138 of the housing 22. Once the terminal assembly 280 is nested, the locking arrangement 236 is snapped into place forming a secured connection of the terminal assembly 280 within the body 231 by locking connections 265, 269, and 273 illustrated in FIG. 31.

A technician may remove the locking arrangement 236, using for example, a screw driver. In an alternative example embodiment, not shown, the locking arrangement 236 rotates into a locked position via a live hinge assembly.

When the body 231 is seated on the riser 138, a secured connection 282 is formed allowing for signal generating coupling between the PCB 70, terminals 72, wire leads 235, and wiring harness 16. The secured connection 282 is maintained when the snap wings 296, and particularly the channel opening 334 pawls 335 that grasp corresponding catches 336 formed in the riser 138 that extends away from the lower side 25A of the central panel 25 as best seen in FIG. 40.

The low profile connection provided by the connection system 230 provides a method of disconnecting the harness 16 from the PCB 70 in a confined space when the height for an application is limited. The low profile characteristic is achieved by several of the features described throughout this disclosure, including for example, the transverse annular channel 304, the assembly forming the connector system 230, and the positioning of the body seal 232 about the connector body 231.

In the illustrated example embodiment of FIGS. 28-29, the connection system 230 is also advantageously field serviceable in that the wire leads 235 coupled to the wiring harness 16 can be disconnected from the enclosure by removing the connector body 231 from the terminals 72. The connector system 230 further advantageously creates a completely sealed system through the lead seals 234 and body seal 232, providing an environment to the electronics 14 free of moisture and/or debris. The sealed electronics 14 in the secure bay 64 opposite the primary bay 48 further provide an advantage of a safe tamper-proof security feature where the electronics are locked into the housing 22 and the monitoring device 20 can only be removed by disconnecting the connecting system 231.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A kit forming a connection system for securing electrical components to a wiring harness, the kit forming the connection system comprising:

a body connector having a first opening interconnected by a transverse channel to a second opening, the first opening for receiving conducting contacts coupled to wire leads during assembly to a wiring harness, the second opening for receiving conducting terminals during assembly to a wiring harness; and an annular seal surrounding a circular perimeter of a head formed on said body connector, said seal having an outer diameter greater than a diameter forming the circular perimeter of said head.

2. The kit forming the connection system of claim 1 further comprising conducting contacts having a first m-shaped clasp formed within said contacts for receiving a first signal lead from said first opening and a second m-shaped clasp formed within said contact for receiving a second signal lead from said second opening.

3. The kit forming the connection system of claim 2 wherein said first signal lead is a wire having a conductive end received within said m-shaped clasp.

4. The kit forming the connection system of claim 2 wherein said second signal lead is a male terminal extending from a printed circuit board.

5. The kit forming the connection system of claim 3 further comprising a plurality of wire leads corresponding to said body connector having as plurality of first and second openings, wherein said wired leads are at least collectively partially covered by a shroud.

6. The kit forming the connection system of claim 1 further comprising a housing having first and second compartments defined by a central panel therebetween, the first compartment for supporting electronics free from contaminates collected externally by said second compartment, the central panel further comprising an annular riser molded into the central panel transversely facing away from the first compartment and toward said second compartment such that said outer diameter of said annular seal surrounding the circular perimeter of said head formed on said body connector nest in annular contact with said inner diameter of said annular riser, preventing the entry of contaminates into the first compartment.

7. The kit forming the connection system of claim 6 further comprising a snap wing molded into said body connector for securing said body connector to said riser, said annular riser having at least one catch projecting from an outer diameter of the annular riser, said catch being received within a channel open of said snap wing.

8. The kit forming the connection system of claim 1 further comprising a locking arrangement for retaining conductive contacts within said first opening during assembly.

9. The kit forming the connection system of claim 6 wherein said housing further comprises at least one flange for securing the housing and kit to a surface to form a tamper-proof area for electronics supported within said first compartment, the tamper-proof area defined by said central panel and said housing when secured to the surface by said at least one flange.

10. The kit forming the connection system of claim 1 wherein the annular seal provides a seal between the body connector and the wiring harness.

11. A connection system for securing electrical components to a wiring harness comprising:

a body connector having a first opening interconnected to a second opening by a transverse channel, the transverse channel supporting a contact assembly along a first plane parallel with said first opening and transverse to a second plane parallel with the second opening;

an annular seal surrounding a circular perimeter of a head formed on said body connector, said seal having an outer diameter greater than a diameter forming the circular perimeter of said head; and a first m-shaped clasp formed within said contact for receiving a signal lead from said first opening and a second m-shaped clasp formed within said contact for receiving a signal lead from said second opening.

12. The connection system of claim 11 wherein the annular seal provides a seal between the body connector and the wiring harness.

13. The connection system of claim 11 wherein said signal lead is a wire having a conductive end received within said m-shaped clasp.

14. The connection system of claim 11 wherein said signal lead is a male terminal extending from a printed circuit board.

15. The connection system of claim 11 further comprising a plurality of wire leads corresponding to said body connector having a plurality of first and second openings, wherein said wired leads are at least collectively partially covered by a shroud.

16. The connection system of claim 11 further comprising a housing having first and second compartments defined by a central panel therebetween, the first compartment for supporting electronics free from contaminates collected externally by said second compartment, the central panel further comprising an annular riser molded into the central panel transversely facing away from the first compartment and toward said second compartment such that said outer diameter of said annular seal surrounding the circular perimeter of said head formed on said body connector nest in annular contact with said inner diameter of said annular riser, preventing the entry of contaminates into the first compartment.

17. The connection system of claim 16 further comprising a snap wing molded into said body connector for securing said body connector to said riser, said annular riser having at least one catch protecting from an outer diameter of the annular riser, said catch being received within a channel open of said snap wing.

18. The connection system of claim 1 further comprising a locking arrangement for retaining said contact assembly within said first opening during assembly.

19. A method of securing electrical components to a wiring harness using a connecting system, the method comprising:

providing a body connector having a first opening interconnected to a second opening by a transverse channel;

supporting a contact assembly with said transverse channel along a first plane parallel with said first opening and transverse to a second plane parallel with the second opening; and sealing a circular perimeter of a head formed on said body connector with a gasket, said gasket having an outer diameter greater than a diameter forming the circular perimeter of said head.

20. The method of claim 19 further comprising the step of providing a first m-shaped clasp formed within said contact assembly for receiving a signal lead from said first opening and providing a second m-shaped clasp formed within said contact assembly for receiving a signal lead from said second opening.

21. The method of claim 19 further comprising the step of providing a housing having first and second compartments defined by a central panel therebetween, the first col for supporting electronics free from contaminates collected externally by said second compartment, the method further comprises providing the central panel with an annular riser molded into the central panel transversely facing away from the first compartment and toward said second compartment such that said outer diameter of said gasket surrounding the circular perimeter of said head formed on said body connector nest in annular contact with said inner diameter of said annular riser, preventing the entry of contaminates into the first compartment.

22. The method of claim 21 further comprising the step of isolating contaminates, debris, and moisture from the first compartment by positioning a seal within said first opening.

23. The method of claim 21 further comprising the step of isolating contaminates debris, and moisture from the first compartment by utilizing said transverse channel between said first and second openings.

* * * * *